US010429767B2

(12) United States Patent
Li et al.

(10) Patent No.: US 10,429,767 B2
(45) **Date of Patent: *Oct. 1, 2019**

(54) SYSTEM AND METHOD OF REMANUFACTURING A TONER CONTAINER

(71) Applicant: Clover Technologies Group, LLC, Ottawa, IL (US)

(72) Inventors: Jun Li, Walnut, CA (US); Eric Tuvesson, Newbury Park, CA (US)

(73) Assignee: CLOVER TECHNOLOGIES GROUP, LLC, Ottawa, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/987,558

(22) Filed: May 23, 2018

(65) Prior Publication Data

US 2018/0267432 A1 Sep. 20, 2018

Related U.S. Application Data

(63) Continuation of application No. 15/274,383, filed on Sep. 23, 2016, now Pat. No. 10,162,288.

(51) Int. Cl.
*G03G 15/08* (2006.01)

(52) U.S. Cl.
CPC ..... *G03G 15/0894* (2013.01)

(58) Field of Classification Search
CPC ..... G03G 15/0894; G03G 21/181; G03G 2215/00987
See application file for complete search history.

(56) References Cited

U.S. PATENT DOCUMENTS

| | | | |
|---|---|---|---|
| 4,833,501 | A | 5/1989 | Büyükgüclü |
| 1,967,207 | A | 10/1990 | Ruder |
| 5,761,584 | A | 6/1998 | Tsuda et al. |
| 6,009,289 | A | 12/1999 | Sekine et al. |
| 6,552,780 | B1 | 4/2003 | Michlin et al. |
| 8,824,918 | B2 | 9/2014 | Kashiide et al. |

(Continued)

FOREIGN PATENT DOCUMENTS

| | | |
|---|---|---|
| EP | 1089135 | 4/2001 |
| JP | H08171281 | 7/1996 |

(Continued)

OTHER PUBLICATIONS

International Search Report and Written Opinion for Application No. PCT/US2017/053016 dated Nov. 11, 2017, 14 pages.

(Continued)

*Primary Examiner* — Sandra Brase
(74) *Attorney, Agent, or Firm* — Michael Best & Friedrich LLP

(57) ABSTRACT

A method of refilling a used flexible toner container having a plurality of toner openings configured to discharge toner during a print operation. The method including forming a fill opening in the used flexible toner container. The fill opening may be formed separately from the toner openings. The method further including attaching a toner seal to the flexible toner container to cover the plurality of toner openings. The method further including, after attaching the toner seal, refilling the flexible toner container via the fill opening. The method further including sealing the fill opening.

39 Claims, 9 Drawing Sheets

(56) References Cited

U.S. PATENT DOCUMENTS

| | | | |
|---|---|---|---|
| 8,867,955 | B2 | 10/2014 | Yamaguchi et al. |
| 9,052,640 | B2 | 6/2015 | Kashiide et al. |
| 9,146,500 | B2 | 9/2015 | Uesugi et al. |
| 9,146,503 | B2 | 9/2015 | Shindo |
| 9,152,081 | B2 | 10/2015 | Yasui et al. |
| 9,213,263 | B2 | 12/2015 | Matsuzaki et al. |
| 9,285,707 | B2 | 3/2016 | Matsushita et al. |
| 9,291,942 | B2 | 3/2016 | Matsuzaki et al. |
| 9,304,439 | B2 | 4/2016 | Matsuzaki et al. |
| 9,304,440 | B2 | 4/2016 | Yoshida et al. |
| 9,304,441 | B2 | 4/2016 | Matsushita et al. |
| 9,310,717 | B2 | 4/2016 | Matsunaga et al. |
| 9,341,983 | B2 | 5/2016 | Yoshida et al. |
| 9,354,552 | B2 | 5/2016 | Takeuchi |
| 9,354,553 | B2 | 5/2016 | Yoshida et al. |
| 9,360,831 | B2 | 6/2016 | Matsuzaki et al. |
| 9,377,714 | B2 | 6/2016 | Nakazawa et al. |
| 9,383,678 | B2 | 7/2016 | Furutani et al. |
| 2001/0021325 | A1 | 9/2001 | Katsuyama et al. |
| 2002/0021915 | A1 | 2/2002 | Nagashima |
| 2003/0123900 | A1 | 7/2003 | Higeta et al. |
| 2003/0235436 | A1 | 12/2003 | Kasahara et al. |
| 2004/0134560 | A1 | 7/2004 | Sato et al. |
| 2004/0257409 | A1 | 12/2004 | Cheok |
| 2005/0226655 | A1 | 10/2005 | Katsuyama et al. |
| 2006/0191590 | A1 | 8/2006 | Wegman |
| 2008/0152395 | A1 | 6/2008 | Da Cruz |
| 2008/0193168 | A1 | 8/2008 | Moon et al. |
| 2009/0016777 | A1 | 1/2009 | Miyamoto et al. |
| 2014/0072346 | A1 | 3/2014 | Furutani et al. |
| 2014/0376955 | A1 | 12/2014 | Takeuchi |
| 2015/0139684 | A1 | 5/2015 | Nakazawa et al. |
| 2015/0234319 | A1 | 8/2015 | Matsumura et al. |
| 2016/0116861 | A1 | 4/2016 | Yamaguchi et al. |
| 2016/0116864 | A1 | 4/2016 | Kase et al. |
| 2016/0124347 | A1 | 5/2016 | Isobe et al. |
| 2018/0088491 | A1* | 3/2018 | Li ..... G03G 15/0894 |

FOREIGN PATENT DOCUMENTS

| | | |
|---|---|---|
| JP | 2003208003 | 7/2003 |
| JP | 2006267679 | 10/2006 |

OTHER PUBLICATIONS

International Search Report and Written Opinion for Application No. PCT/US2017/053004 dated Dec. 6, 2017, 14 pages.

* cited by examiner

SYSTEM AND METHOD OF REMANUFACTURING A TONER CONTAINER

CROSS-REFERENCE TO RELATED APPLICATIONS

This application claims benefit to prior-filed, co-pending U.S. application Ser. No. 15/274,383, filed Sep. 23, 2016, the entire contents of which are incorporated by reference herein.

BACKGROUND

The application generally relates to imaging, or printer, cartridges.

SUMMARY

Printing systems, such as high volume printing devices (e.g., network printers, photocopiers, etc.), typically use toner cartridges which store and transmit toner to an intended medium, such as paper. Once the toner has depleted, the used toner cartridge is removed from the printing system, and typically disposed of. Remanufacturing of used toner cartridges permits the toner cartridges to be reused rather than disposed of in landfills.

Toner cartridges come in a variety of configurations. Although specific constructions vary among manufacturers and printers, many toner cartridges include components such as a toner hopper, a variety of toner-regulating blades, a developer roller, a primary charge roller, and an organic photo-conductor drum.

To avoid discarding useful materials and to thereby reduce the environmental impact of printing operations, many toner cartridges may be remanufactured. Remanufacturing involves collecting used toner cartridges that, prior to their use, were brand new cartridges typically supplied by the manufacturer of the printer with which the cartridges are compatible. These cartridges are often referred to in the art as "OEM cartridges" because they are supplied by the original equipment manufacturer, i.e., the manufacturer of the printer and the compatible printer cartridge.

Remanufacturing of toner cartridges typically includes, among other things, disassembling the toner cartridge, cleaning the toner cartridge, refilling the toner hopper with new toner, repairing or replacing worn or damaged components, and reassembling the toner cartridge. Reassembly the toner cartridge typically includes providing a toner seal that covers a toner opening provided in the toner hopper through which toner is dispensed during operation of the cartridge. These seals are removable either manually by a user or by a mechanism included in the toner cartridge or the image forming apparatus into which it is installed just prior to the toner cartridge being used for a printing operation. The primary function of the seal is to prevent toner from leaking out of the toner opening of the cartridge during transportation and shipping of the toner cartridge.

As discussed above, some toner cartridges may include a seal that is removable by a mechanism included within the toner cartridge. Such toner cartridges may include a toner bag, or container, having one or more toner openings. Toner is stored in the toner container and exits through the one or more toner openings during printing operations. During transportation, the seal covers the one or more toner openings. Once installed in a printing system, a mechanism, such as an unsealing member or seal puller, is rotated by a driving means of the printing system. Rotation of the unsealing member removes the seal from the toner container in order to allow toner to exit through the one or more toner openings.

In one embodiment, the invention provides a method of refilling a used flexible toner container having a plurality of toner openings configured to discharge toner during a print operation. The method including forming a fill opening in the used flexible toner container. The fill opening may be formed separately from the toner openings. The method further including attaching a toner seal to the flexible toner container to cover the plurality of toner openings. The method further including, after attaching the toner seal, refilling the flexible toner container via the fill opening. The method further including sealing the fill opening.

In another embodiment, the invention provides a method for remanufacturing a toner cartridge. The method including providing a used toner cartridge including a toner hopper having a flexible toner container therein and opening the toner hopper. The method further including removing the flexible toner container from the toner hopper. The flexible toner container may have a plurality of toner openings configured to discharge toner during a print operation. The method further including forming a fill opening in the flexible toner container. The fill opening may be formed separately from the toner openings. The method further including attaching a toner seal to the flexible toner container to cover the plurality of toner openings and, after attaching the toner seal, refilling the flexible toner container with toner via the fill opening. The method further including sealing the fill opening and reinstalling the refilled flexible toner container into the hopper.

Other aspects of the invention will become apparent by consideration of the detailed description and accompanying drawings.

DETAILED DESCRIPTION

Before any embodiments of the application are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
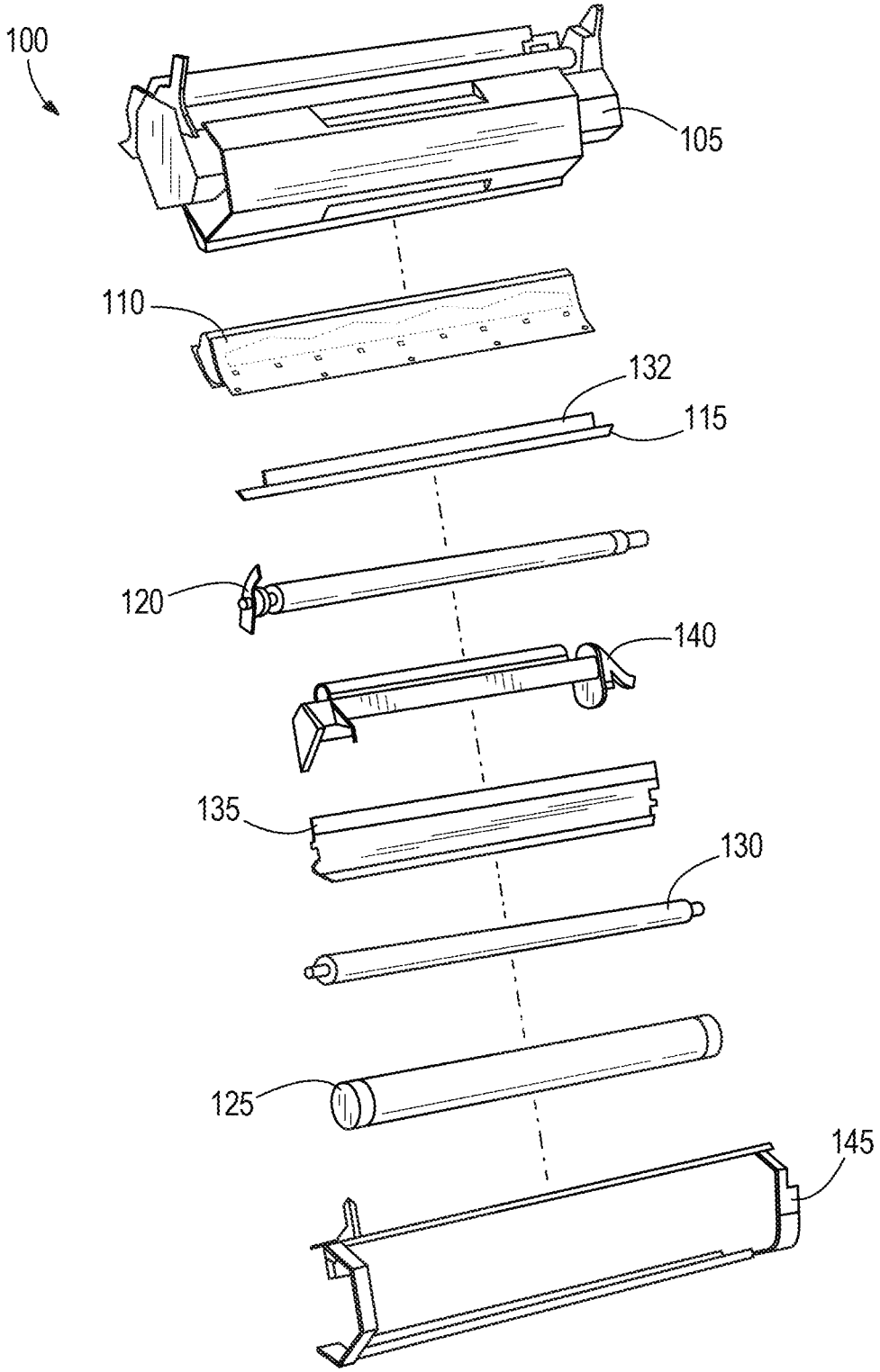
FIG. 1 is an exploded view of a toner cartridge according to some embodiments of the application.

FIG. 1 is an exploded view of a toner cartridge 100 according to some embodiments of the application. The toner cartridge 100 is a consumable component used in a printing system (e.g., network printers, laser printers, photocopiers, etc.). The toner cartridge 100 stores and, in cooperation with components of a compatible printer, transfers toner to an intended medium (e.g., paper).

The toner cartridge 100 includes a toner hopper 105 for storing a mass of toner. A toner seal 110 is configured to seal the toner within the toner hopper 105. In some embodiments, the toner hopper 105 is a non-pull seal toner hopper. In such an embodiment, the toner seal 110 (FIG. 2) is an internal seal and is automatically removed during operation by the end user.

The toner cartridge 100 of the illustrated embodiment is an "all-in-one" cartridge and further includes the following components or elements: a metering blade (e.g., a charge blade or doctor blade) 115; a developer roller (i.e., a magnetic roller or a developer unit) 120; an organic photoconductor (OPC) drum 125; and a primary charge roller (PCR) 130. In other embodiments, the toner cartridge 100 may include more or fewer components. For example, alternative embodiments of the cartridge 100 may be developer cartridges that do not include an OPC drum or a PCR. In such embodiments, the OPC drum and PCR may be part of the printer or may be provided as a separately removable drum unit.

During operation, toner is collected from the toner hopper 105 by the rotating developer roller 120 and magnetically or electrostatically transferred from the developer roller 120 to the OPC drum 125. A laser system having a laser beam, located within the printing system, scans an electrostatic image onto the OPC drum 125 with the laser beam. In some printers, the electrostatic image produced by the laser corresponds to the image to be printed. In other printers, the laser forms an electrostatic image that is a negative of the image that is to be printed. Regardless of the specific configuration, toner carried by the developer roller 120 is electrostatically attracted to the electrostatic image produced on the OPC drum 125 by the laser beam. The OPC drum 125 then applies the toner, which is in a pattern corresponding to the desired image, onto the intended medium by direct contact or by further electrostatic transfer. The toner is then fused to the intended medium, typically by way of a heating element (e.g., a fuser).

The illustrated toner cartridge 100 further includes a wiper blade 135. The wiper blade 135 contacts the OPC drum 125 and wipes residual toner (i.e., toner remaining on the OPC drum 125 after transfer to the intended medium) from the OPC drum 125. The wiped residual toner is collected by a waste bin 140.

In some embodiments, the toner cartridge 100 further includes a drum shutter 145. The drum shutter 145 protects the OPC drum 125 from physical damage and exposure to light when the toner cartridge 100 is not installed in the printing system.

Figure 2:
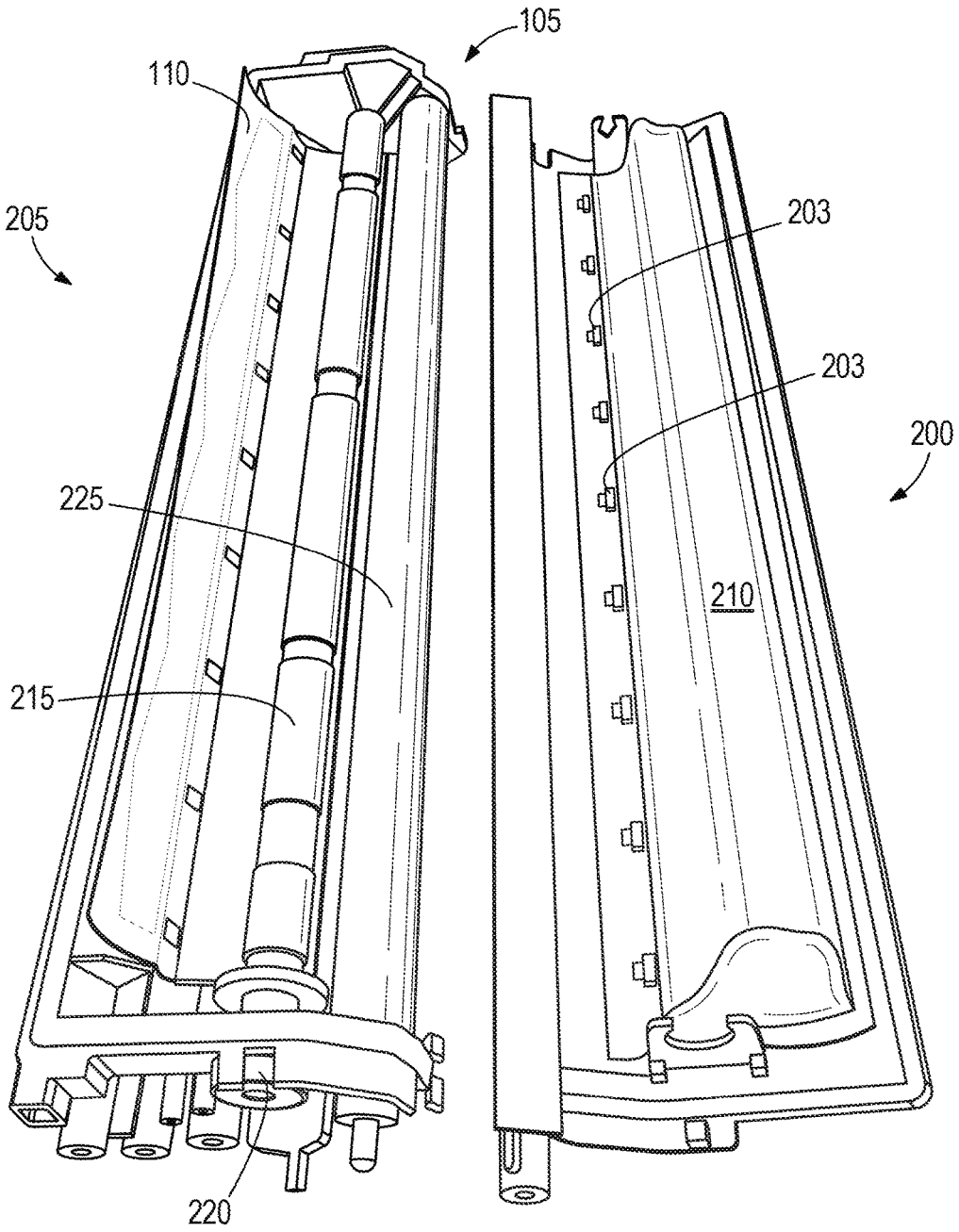
FIG. 2 is a top perspective view of a toner hopper, of the toner cartridge of FIG. 1, with a toner hopper lid removed from a toner hopper base according to some embodiments of the application.

FIG. 2 illustrates the toner hopper 105 with a toner hopper lid 200 removed from a toner hopper base 205 according to some embodiments of the application. The toner hopper lid 200 includes a flexible toner bag, or container, 210 releasably coupled to the toner hopper lid 200. The hopper lid 200 includes attachment posts 203 that releasably secure the toner bag 210 to the lid 200. The toner hopper base 205 includes the seal 110, a seal puller 215, a gear 220, and an adder roller 225. The seal 110 is coupled to the seal puller 215 and in some embodiments is composed of a polymer. The seal puller 215 is rotatably supported within the toner hopper base 205. The seal puller 215 is configured to rotate in response to rotational movement of the gear 220. In some embodiments, gear 220 is rotated via a driving means of the printing system.

Figure 3:
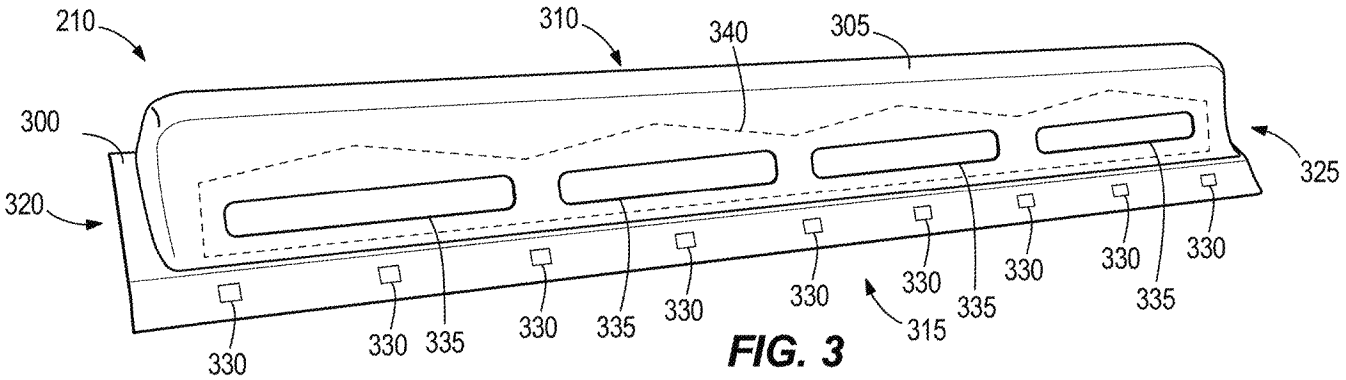
FIG. 3 illustrates a toner bag removed from the toner hopper lid of FIG. 2 according to some embodiments of the application.

FIG. 3 illustrates the toner bag 210 removed from the toner hopper lid 200 according to some embodiments of the application. The toner bag 210 is a flexible, highly deformable container for storing a supply of toner that is secured within the generally rigid toner hopper 105. The toner bag 210 includes a base 300 and a body 305. In the illustrated configuration the base 300 is a substantially flat and formed of a first material, and the body 305 is substantially dome-shaped and formed of a second material. The base 300 and the body 305 are joined to one another along a perimeter of the base 300 such that the toner bag 210 comprises a first elongated side 310, a second elongated side 315, a third side 320, and a fourth side 325. The first material that forms the base 300 may be comprised of an air-permeable, toner-impermeable material, and the base 300 may include one or more securement apertures 330 configured to receive the attachment posts 203 of the hopper lid 200 to secure the toner bag 210 to the toner hopper lid 200, as shown in FIG. 2. In the illustrated embodiment, the securement apertures 330 are defined by the base 300 proximate the second elongated side 315. The body 305 is coupled to a periphery of the base 300. The body 305 may be comprised of an air-impermeable, toner-impermeable material. In some embodiments, the material of the body 305 is a flexible polymer or similar material. The body 305 includes one or more toner openings, or apertures, 335 defined by the body 305. Although illustrated as four openings, in other embodiments, the body 305 may have more or less toner openings 335. The toner openings 335 allow toner to pass from the toner bag 210 to the interior of the toner hopper 105. The body 305 also includes adhesion points 340, shown in broken lines in FIG. 3, indicating where the seal 110 is secured to the body 305 to cover the openings 335, as discussed further below.

Figure 4A:
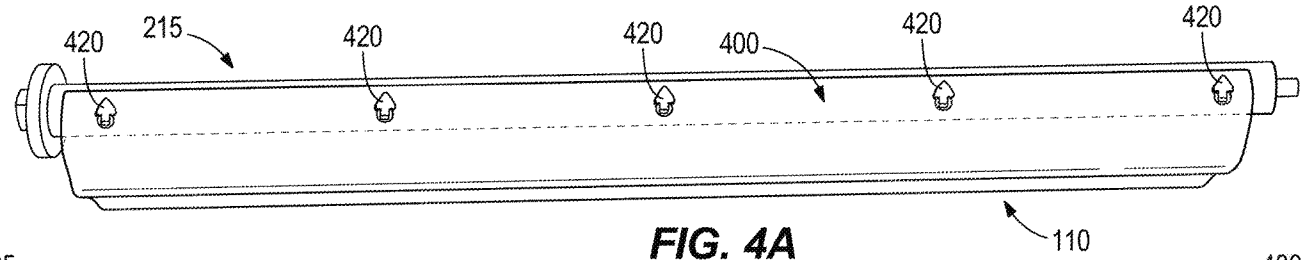
FIG. 4A is a front view of a seal and a seal puller of the toner hopper of FIG. 2 according to some embodiments of the application.
Figure 4B:
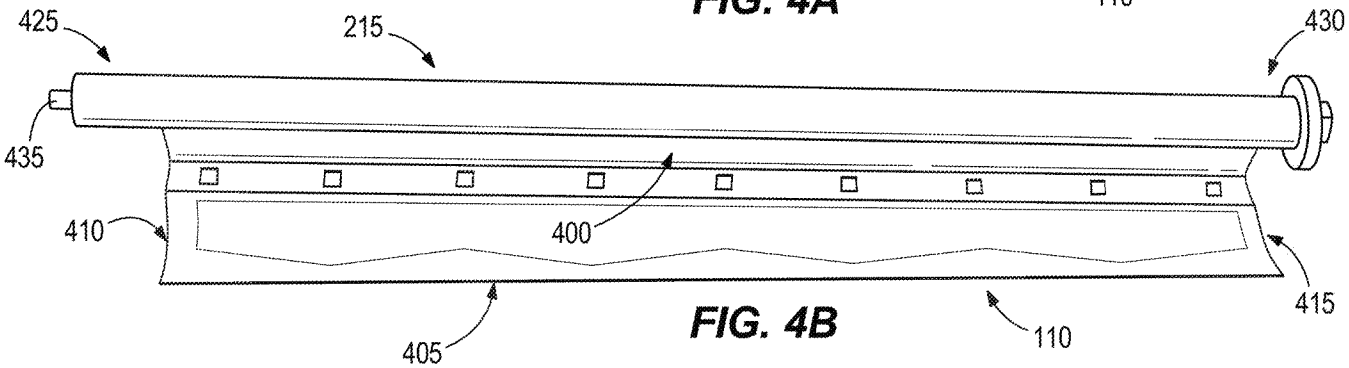
FIG. 4B is a rear view of the seal and the seal puller of FIG. 4A according to some embodiments of the application.

FIGS. 4A and 4B illustrate the seal 110 and seal puller 215 removed from the toner hopper base 205 according to some embodiments of the application. The seal includes a first elongated side 400, a second elongated side 405, a third side 410, and a fourth side 415. An attachment portion of the seal 110 may be coupled to the seal puller 215 along the first elongated side 400 via one or more securement points 420. The seal puller 215 includes a first end 425 and a second 430. The first end 425 is configured to be rotationally supported by the toner hopper base 205. In some embodiments, the first end 425 includes a pin 435. The second end 430 may be configured to non-rotatably couple to the gear 220 such that rotational movement of the gear 220 is transferred to the seal puller 215.

Figure 5:
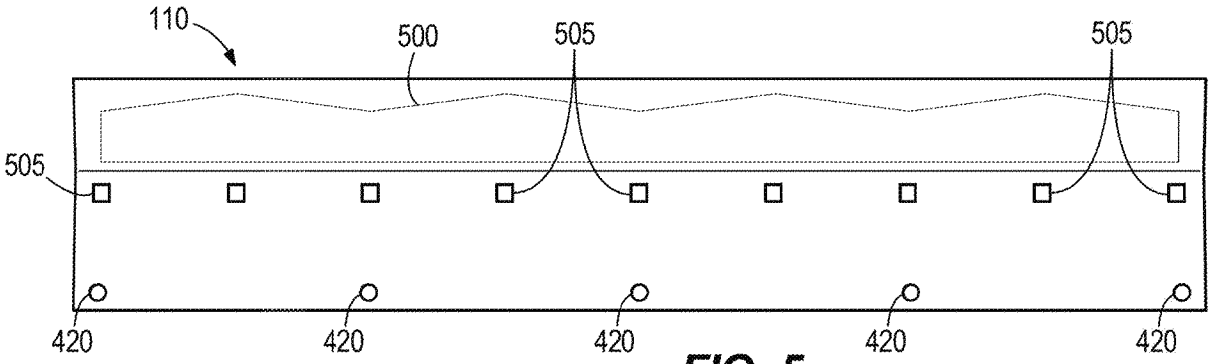
FIG. 5 is a front view of the seal of FIGS. 4A and 4B according to some embodiments of the application.
Figure 6:
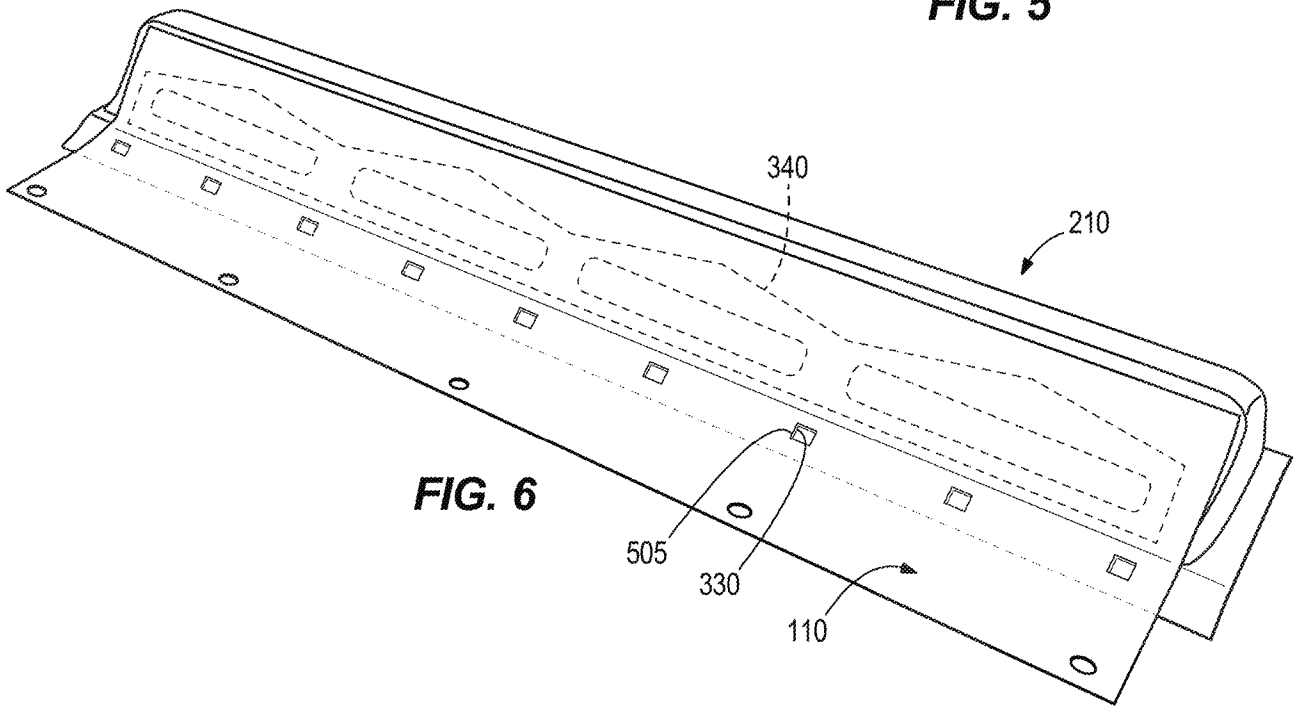
FIG. 6 is a perspective view of the seal of FIG. 5 secured to the toner bag of FIG. 3 according to some embodiments of the application.

FIG. 5 illustrates the seal 110 removed from the seal puller 215 according to some embodiments of the application. A sealing portion of the seal 110 is configured to cover or overlie the toner openings 335 and includes one or more adhesions 500. In the illustrated embodiment, the adhesions 500 are remnants of a sonic welding operation performed by the OEM to attach the seal 110 to the toner bag 210. The illustrated adhesions 500 are proximate the second elongated side 405. As illustrated in FIG. 6, the adhesions 500 releasably secure the seal 110 to the toner bag 210 along the adhesion points 340 (FIG. 3). In the illustrated embodiment the seal 110 also includes a plurality of alignment openings 505 spaced along the length of the seal 110 generally between the first elongated side 400 and the second elongated side 405. The alignment openings 505 align with securement apertures 330 of the base 300 when the seal 110 is coupled to the toner bag 210.

Figure 7:
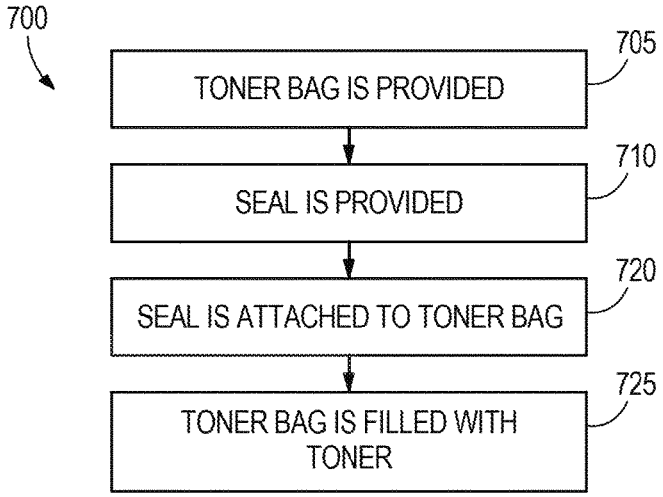
FIG. 7 is a flow chart illustrating an operation for filling the toner bag of FIG. 6 with toner according to some embodiments of the application.

FIG. 7 is a flow chart illustrating a process, or operation, 700 for filling the toner bag 210 with toner according to some embodiments of the application. It should be understood that the order of the steps disclosed in process 700 could vary. Furthermore, additional steps may be added to the sequence and not all of the steps may be required. A toner bag 210 having toner openings 335 is provided (block 705). In some embodiments, providing the toner bag 210 includes removing an original equipment manufacturer toner bag from a toner hopper 105. A seal 110 is provided (block 710). In some embodiments, providing the seal 110 includes removing an original equipment manufacturer seal from a toner hopper 105. In some embodiments, providing the toner bag 210 and seal 110 includes cleaning the toner bag 210 and seal 110. In some embodiments, the toner bag 210 and seal 110 are cleaned using compressed air and/or dry wipes under a fume hood. The seal 110 is secured to the body 305 of the toner bag 210 (block 720). The toner bag 210, with attached seal 110, is filled with toner (block 725). Filling the toner bag 210, with attached seal 110, with toner may be completed using the systems and methods discussed below with respect to FIGS. 12-15.

Figure 8:
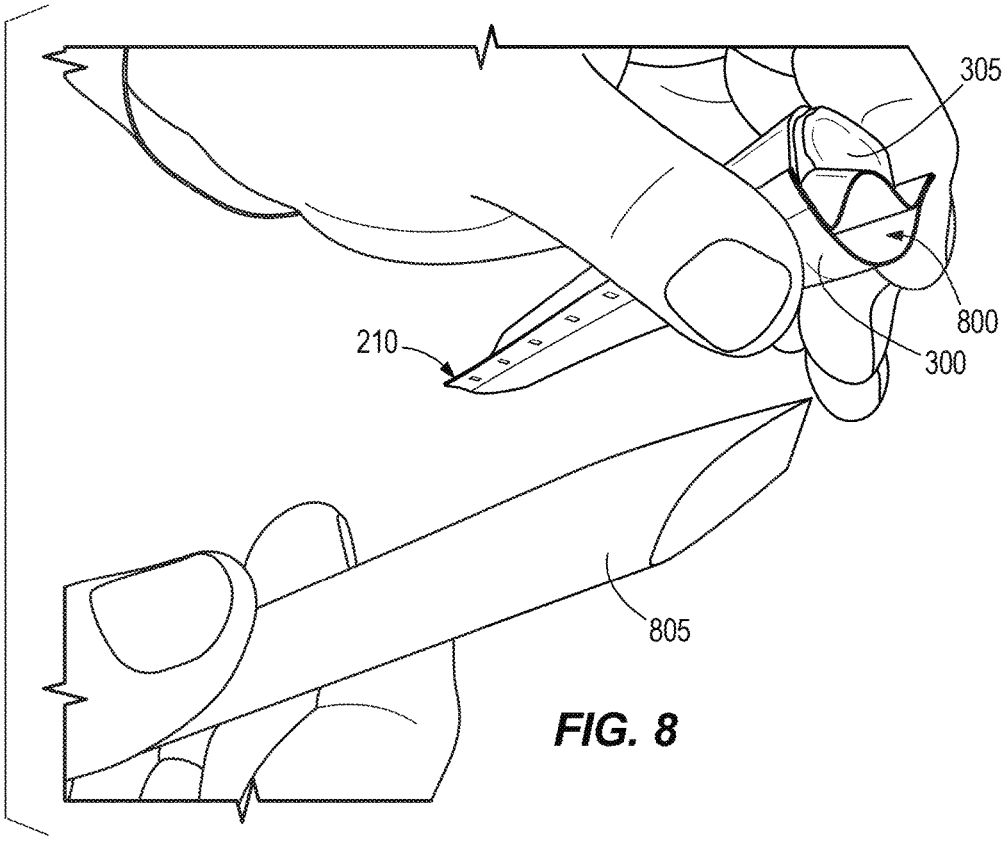
FIG. 8 is a perspective view of providing an opening in the toner bag of FIG. 6 according to some embodiments of the application.

As illustrated in FIG. 8, in some embodiments, the step of filling the toner bag 210 with toner includes providing a fill opening 800 on one longitudinal end of the toner bag 210, which in the illustrated configuration includes providing the fill opening 800 on the third side 320 of the toner bag 210. In some embodiments, the fill opening 800 is provided by separating the body 305 from the base 300. In such embodiments, a chisel, or similar tool, 805 may be used to separate the body 305 from the base 300. For example, the chisel may be inserted through a toner opening 335 and urged in between the body 305 and the base 300 to create the fill opening 800. In other embodiments, the fill opening 800 may be formed by cutting, stamping, or otherwise forming an opening in one or both of the body 305 and the base 300 to permit refilling.

Figure 9:
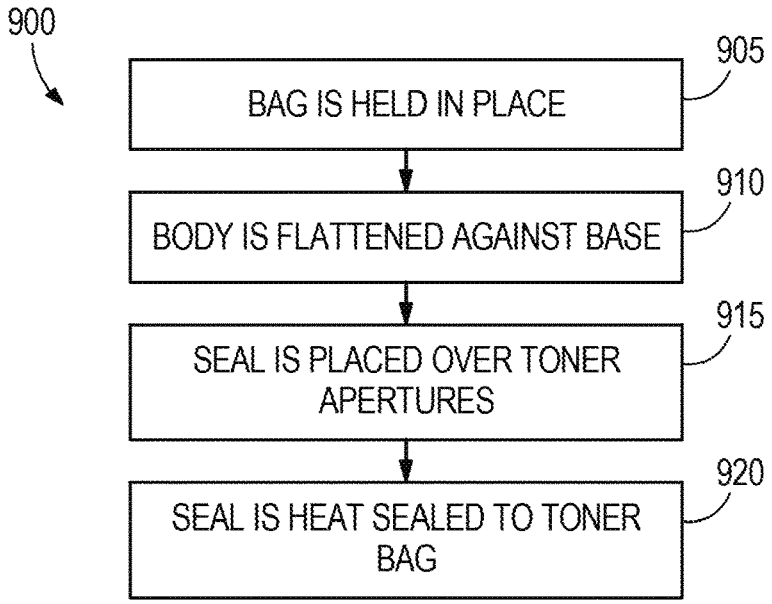
FIG. 9 is a flow chart illustrating an operation for attaching the seal of FIG. 5 to the toner bag of FIG. 3 according to some embodiments of the application.

FIG. 9 is a flow chart illustrating a process, or operation, 900 for attaching the seal 110 to the toner bag 210 according to some embodiments of the application. It should be understood that the order of the steps disclosed in process 900 could vary. Furthermore, additional steps may be added to the sequence and not all of the steps may be required. The base 300 of the toner bag 210 is held in place (block 905). In some embodiments, the base 300 is held in place by a holder. In such an embodiment, the base 300 may be held in place by securement apertures 330 of the base 300. The body 305 is then flattened against the base 300 such that toner openings 335 lay flat against the base 300 (block 910). The seal 110 is then placed over the toner openings 335 (block 915). In some embodiments, when the seal 110 is placed over the toner openings 335, the alignment openings 505 of the seal 110 are aligned with the securement apertures 330 of the base 300 and may be used to properly locate the seal 110 with respect to the toner bag 210. The seal 110 is then attached to the body 305 (block 920), for example by heat sealing. In some embodiments, the seal 110 is attached to the body 305 using an adhesion pattern that is similar to the adhesion pattern used by the original equipment manufacturer.

In some embodiments, the seal 110 may be coupled to the seal puller 215 before the seal 110 is attached to the body 305 of the toner bag 210. For example, in embodiments in which the seal 110 is a reused original equipment manufacturer seal 110, when the cartridge 100 is disassembled for remanufacturing the seal 110 may be left attached to the seal puller 215 throughout disassembly and throughout the process 900. By leaving the seal 110 attached to the seal puller 215, or by attaching the seal 110 to the seal puller 215 before the seal is attached to the body 305 of the toner bag 210, the toner bag 210, seal 110, and seal puller 215 may be reinstalled into the hopper 105 as a unit, thereby minimizing handling and reducing the likelihood of the seal 110 becoming detached from the toner bag 210 during reassembly. Alternatively, the toner bag 210 and seal 110 may be installed into the hopper lid 200 and thereafter the seal puller 215 may be attached to the seal 110 via the securement points 420.

Figure 10A:
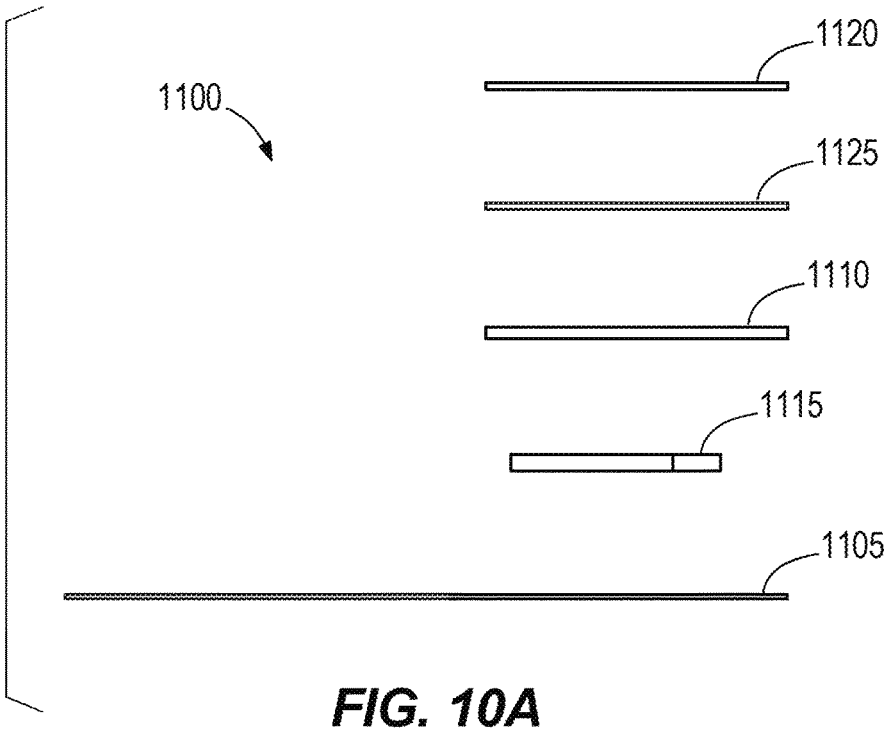
FIG. 10A is an exploded side view of a seal of the toner hopper of FIG. 2 according to another embodiment of the application.
Figure 10B:
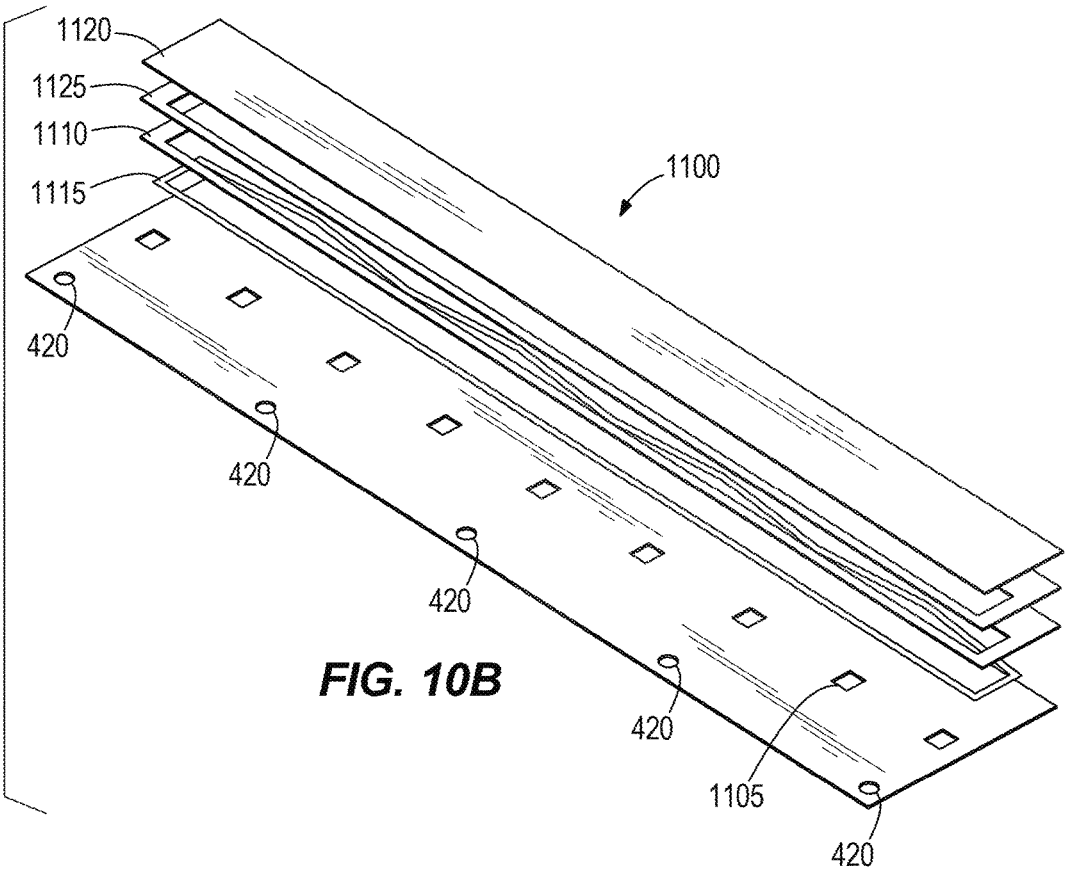
FIG. 10B is an exploded perspective view of the seal of FIG. 10A according to some embodiments of the application.

FIGS. 10A and 10B illustrate a seal 1100 according to some embodiments of the application. The seal 1100 may be an unused, or aftermarket, seal configured to be attached to a used, original equipment manufacturer toner bag 210 or to an aftermarket toner bag 210. The seal 1100 includes a seal base 1105. Similar to seal 110, the seal base 1105 includes one or more securement points 420 and a plurality of alignment openings 505. As discussed above, the securement points 420 may be used to couple the seal 1100 to the seal puller 215 and the alignment openings 505 may be used to align the seal 1100 with the toner bag 210 during assembly. The seal base 1105 may comprised of a mylar or similar material. In some embodiments, the seal base 1105 is approximately 0.7 mm thick. A seal plate 1110 is secured to the seal base 1105. In the illustrated embodiment, the seal plate 1110 is secured to the seal base 1105 via a heat seal pattern 1115 that is similar to the attachment pattern used by the original equipment manufacturer. In some embodiments, the seal plate 1110 is approximately 0.2 mm thick. The seal plate 1110 includes one or more toner apertures configured for alignment with toner openings 335 of the toner bag 210. A release liner 1120 is secured to the seal plate 1110. In the illustrated embodiment, the release liner 1120 is secured to the seal plate 1110 via a layer of double-sided adhesive 1125. In such an embodiment, the double-sided adhesive 1125 may be shaped substantially similar to the seal plate 1110, and may include one or more apertures similar to apertures of the seal plate 1110.

Figure 11:
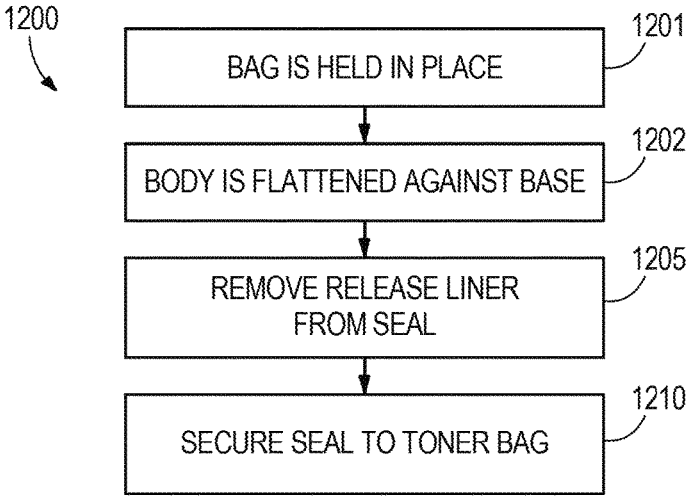
FIG. 11 is a flow chart illustrating an operation for filling a toner bag of the toner hopper of FIG. 2 with toner according to some embodiments of the application.

FIG. 11 is a flow chart illustrating a process, or operation, 1200 for attaching seal 1100 to the toner bag 210 according to some embodiments of the application. It should be understood that the order of the steps disclosed in process 1200 could vary. Furthermore, additional steps may be added to the sequence and not all of the steps may be required. The base 300 of the toner bag 210 is held in place (block 1201). In some embodiments, the base 300 is held in place by a holder. In such an embodiment, the base 300 may be held in place by the securement apertures 330 of the base 300. The body 305 is then flattened against the base 300 such that toner openings 335 lay flat against the base 300 (block 1202) and are substantially parallel thereto. The release liner 1120 is removed from the seal 1100 (block 1205) to expose the double-sided adhesive 1125. The seal 1100 is secured to the toner bag 210 via the double-sided adhesive 1125 (block 1210). In some embodiments, the alignment openings 505 of the seal 1100 may be aligned with the securement apertures 330 of the base 300 to correctly position the seal 1100 during attachment to the toner bag 210. In the descriptions that follow it should be appreciated that the seal 110 and the seal 1100 are alternatives to one another and that, except as noted or for reasons apparent to those skilled in the art, embodiments described as including one may include the other.

During an unsealing operation involving the seal 1100 and a toner bag 210, the seal base 1105 is coupled to the seal puller 215 by way of the securement points 420. When the seal puller 215 rotates, it pulls on the seal base 1105 which in turn applies stress to the heat seal pattern 1115. The stress overcomes the adhesive strength of the heat seal pattern 1115 and the seal base 1105 is pulled away from the seal plate 1110, which remains securely attached to the toner bag 210 by way of the adhesive 1125. When the seal base 1105 is completely removed from the seal plate, toner is allowed to pass through the toner openings 335 in the toner bag 210 and through the toner opening defined by the seal plate 1110. In preferred embodiments, the strength of the heat seal pattern 1115 and the strength of the adhesive 1125 are selected such that, when the seal base 1105 is pulled away from the toner bag 210 by the seal puller 215, the seal plate 1110 remains fixed to the toner bag 210 and the seal base 1105 separates from the seal plate 1110.

Figure 12:
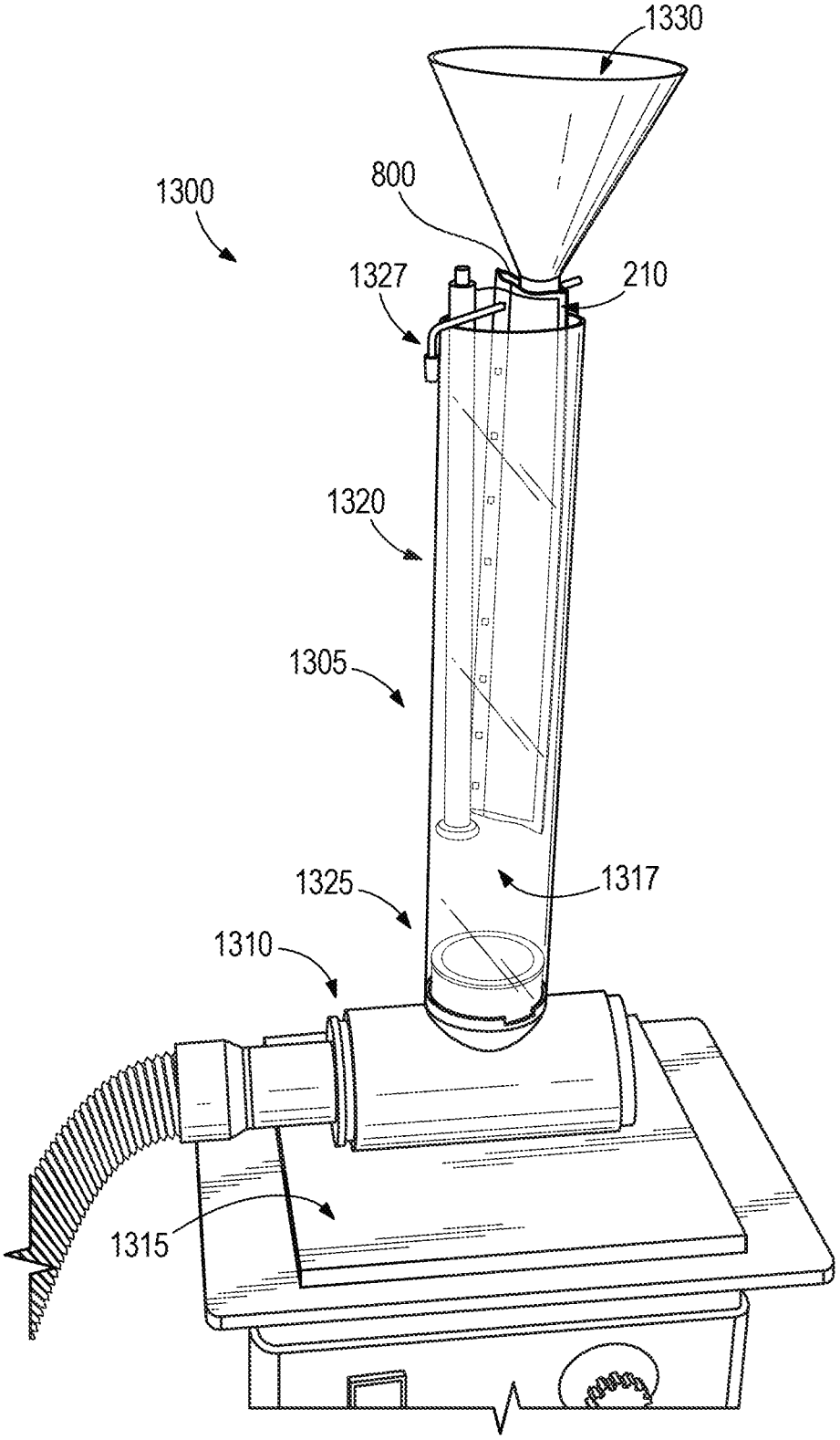
FIG. 12 is a front view of a toner filler for filling a toner bag of the toner hopper of FIG. 2 with toner according to some embodiments of the application.

FIG. 12 illustrates a toner filler 1300 for filling a toner bag 210 with toner according to some embodiments of the application. The toner filler 1300 includes a receiving portion in the form of a receiving tube 1305, a vacuum source 1310, and an agitator 1315. The receiving tube 1305 defines a chamber 1317 and has a first end 1320 and a second end 1325. The first end 1320 is opened and configured to receive the toner bag 210. The second end 1325 is coupled to the vacuum source 1310 such that the receiving tube 1305 and the chamber are in fluid communication with the vacuum source 1310. The toner bag 210 may be received such that the fill opening 800 (FIG. 8) of the toner bag 210 is proximate the first end 1320 of the receiving tube 1305. In some embodiments, including the illustrated embodiment, the fill opening 800 of the toner bag 210 is positioned outside of the chamber, just above the first end 1320 of the receiving tube 1305, while other portions of the toner bag 210 are positioned inside the chamber and within the receiving tube 1305. The toner filler 1300 may include a support member 1327 for supporting positioning and supporting the toner bag 210 as described above. Once the toner bag 210 is positioned and supported relative to the receiving tube 1305, a funnel 1330 may be placed in the fill opening 800 of the toner bag 210. Although the figures and description refer to a receiving tube 1305, it should be appreciated that substantially any suitably shaped container may be used to define the chamber 1317.

The vacuum source 1310 provides a suction force. In some embodiment, the vacuum source 1310 includes a rotor, or impeller, driven by a motor. In such an embodiment, the motor may be an alternating-current (AC) motor or a direct-current (DC) motor. The agitator 1315 is configured to agitate the receiving tube 1305, and thus the toner bag 210. In some embodiments, the agitator 1315 is a vibrating base configured to vibrate the receiving tube 1305 to promote agitation of toner, and thus filling of the toner bag 210 with the toner. In some embodiments, the agitator includes a motor (for example, an AC motor or a DC motor). In some embodiments, the motor may be the same motor as the vacuum source 1310.

Figure 13:
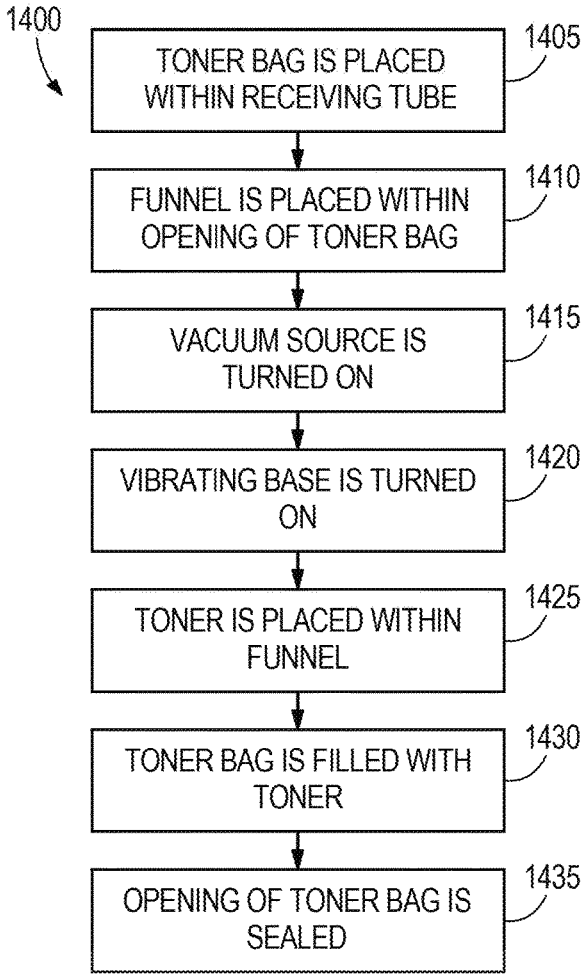
FIG. 13 is a flow chart illustrating an operation for filling a toner bag of the toner hopper of FIG. 2 with toner according to some embodiments of the application.

FIG. 13 is a flow chart illustrating a process, or operation, 1400 for filling the toner bag 210 with toner according to some embodiments of the application. It should be understood that the order of the steps disclosed in process 1400 could vary. Furthermore, additional steps may be added to the sequence and not all of the steps may be required. The toner bag 210 is placed within the receiving tube 1305 (block 1405). In the illustrated embodiment of FIG. 12, the toner bag 210 is coupled to the seal 110, 1100 and seal puller 215 when placed within the receiving tube 1305, however, in other embodiments, the toner bag 210 may only be coupled to the seal 110, 1100. The funnel 1330 is then placed within the fill opening 800 of the toner bag 210 (block 1410). The vacuum source 1310 is turned on (block 1415).

Figure 14:
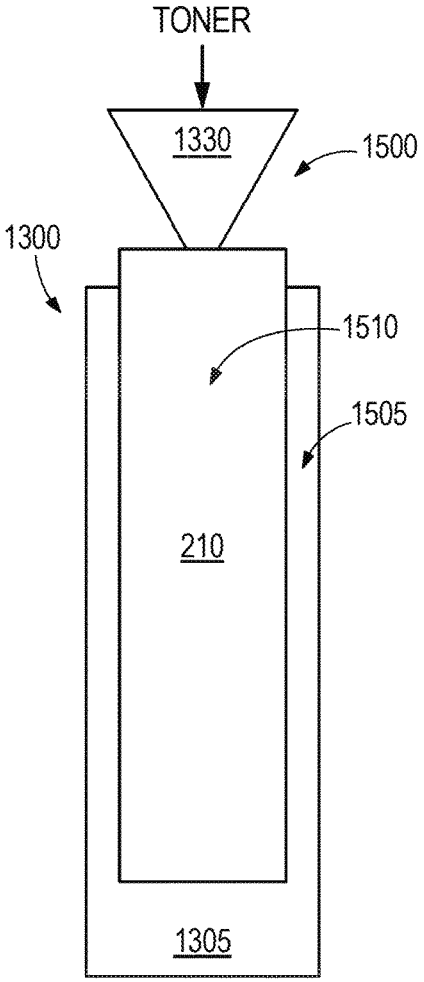
FIG. 14 is a block diagram of the toner filler of FIG. 12 according to some embodiments of the application.

FIG. 14 illustrates a block diagram of the toner filler 1300 according to some embodiments of the application. As illustrated, when the vacuum source 1310 is turned on, a pressure differential is created. Outside the receiving tube 1305 is an atmospheric pressure 1500. Within the receiving tube 1305, but outside the toner bag 210 is a first pressure 1505, and within the toner bag 210 is a second pressure 1510. The first pressure 1505 and the second pressure 1510 are both less than the atmospheric pressure 1500. Additionally, the first pressure 1505 is less than the second pressure 1510. Such a pressure differential causes the toner bag 210 to at least partially expand or inflate. The first pressure 1505 is controlled by the vacuum source 1310. The second pressure 1510 is controlled by the amount of atmospheric pressure 1500 and by the amount of resistance to air flow of the air-permeable but toner-impermeable base 300 of the toner bag 210. The pressure differential between the first pressure 1505 and the second pressure 1510 should be enough to inflate the toner bag 210 without putting stress on the structure of the toner bag 210. In some embodiments, the first pressure 1505 is approximately 10% to approximately 30% less than the atmospheric pressure 1500.

Returning to FIG. 13, the vibrating base 1315 is turned on (block 1420). Toner is placed within the funnel 1330 (block 1425). Toner placed within the funnel 1330 will be pulled into the toner bag 210 because of the pressure differential discussed above with respect to FIG. 15. Additionally, because the base 300 of the toner bag 210 is air-permeable, but toner-impermeable, the toner remains within the toner bag 210 when the vacuum source 1310 is on. The vibration of the vibrating base 1315 further promotes filling of the toner bag 210 with toner. Once the toner bag 210 is filled with toner (block 1430), the toner bag 210 is removed from the receiving tube 1305 and the fill opening 800 of the toner bag 210 is sealed (block 1435). In some embodiments, the fill opening 800 is sealed using a heating iron. In such an embodiment, the filled toner bag 210 is placed with the base 300 facing upwards. Heat is then applied to the base 300 proximate the third side 320 until the third side 320 is sealed.

Figure 15:
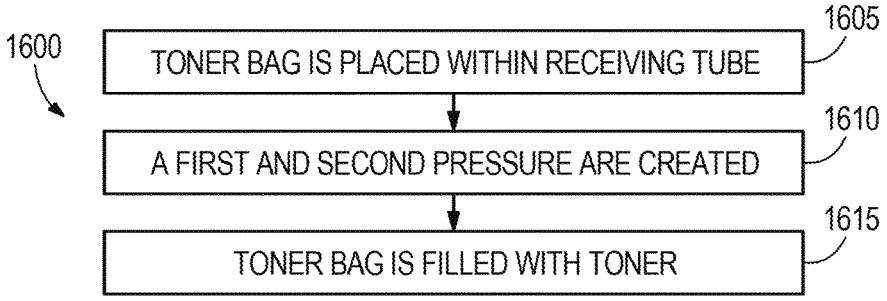
FIG. 15 is a flow chart illustrating an operation for filling a toner bag of the toner hopper of FIG. 2 with toner according to some embodiments of the application.

FIG. 15 is a flow chart illustrating a process, or operation, 1600 for filling the toner bag 210 with toner according to some embodiments of the application. It should be understood that the order of the steps disclosed in process 1600 could vary. Furthermore, additional steps may be added to the sequence and not all of the steps may be required. The toner bag 210 is placed within the receiving tube 1305 (block 1605). In the illustrated embodiment of FIG. 12, the toner bag 210 is coupled to the seal 110, 1100 and seal puller 215 when placed within the receiving tube 1305, however, in other embodiments, the toner bag 210 may only be coupled to the seal 110, 1100. Create a first pressure 1505 in the receiving tube 1305 and a second pressure 1510 in the toner bag 210 (block 1610). Fill the toner bag 210 with toner (block 1615). In some embodiments, the step of filling the toner bag 210 with toner is at least partially performed by a pressure differential between the first pressure 1505 and the second pressure 1510.

In view of the forgoing, a remanufacturing process may be provided substantially as follows: A used toner cartridge 100 of the type including a toner bag 210, a seal 110, and an internal seal puller 215 may be provided. The lid 200 of the toner cartridge 100 may be removed from the hopper base 205, for example by removing screws and/or pins, separating sonic welds, and the like. When the lid 200 is removed, the toner bag 210 may remain secured to the lid 200, while the seal puller 215 and the seal 110 remain secured to the hopper base 205, as shown for example in FIG. 2. With the lid 200 removed the bag 210 may be removed from the lid and the seal 110 and the seal puller 215 may be removed from the hopper base 205. As discussed above it may be advantageous to leave the seal 110 attached to the seal puller 215 through the resealing and refilling process to minimize handling of the seal 110 once the seal is reattached to the toner bag 210. Alternatively the seal 110 may be removed from the seal puller 215 and reattached to the seal puller after the seal 110 is reattached to the toner bag 210.

The removed seal 110 and toner bag 210 may then be inspected for excessive damage. If the seal 110 and toner bag 210 are in a condition suitable for reuse, the seal 110 may be reattached to the toner bag 210. Before reattaching the seal 110 to the toner bag 210, the toner fill opening 800 may be formed in one end of the toner bag 210, for example using the chisel 805 or a similar tool as described above with respect to FIG. 8. With the fill opening 800 formed, the toner bag 210 may be placed in a sealing fixture and the seal 110 may be positioned over the toner openings 335. The alignment openings 505 of the seal 110 may be aligned with the securement apertures 330 of the toner bag 210 to provide proper alignment of the seal 110 and the toner bag 210. A heat sealing operation may then be performed to seal the seal 110 to the toner bag 210. In some embodiments the heat sealing operation uses a heated platen that produces the same pattern of adhesions 500 (see FIG. 5) as used on the original equipment cartridge 100. In other embodiments sonic welding may be used in place of heat sealing. In still other embodiments, for example in embodiments where one or both of the removed seal 110 and the removed toner bag 210 are damaged beyond what is acceptable for reuse, a new seal similar to the seal 110 or an alternative seal similar to the seal 1100 shown in and described with respect to FIGS. 10A and 10B may be provided, and/or a new toner bag similar to the toner bag 210 may be provided. The new seal and/or new toner bag may be attached to one another or to a removed but usable seal 110 or toner bag 210, as the case may be.

With the seal 110 attached to the toner bag 210 and the toner openings 335 covered by the seal 110, the toner bag 210 may be refilled with toner via the toner fill opening 800. In some embodiments, the toner filler 1300 may be used to refill the toner bag 210, substantially as described above. When the toner bag 210 is sufficiently refilled with toner the toner fill opening 800 may be closed, for example by heat sealing, sonic welding, adhesive, or the like.

The filled toner bag 210 with seal 110 and seal puller 215 attached may then be reinstalled into the toner cartridge 100. The toner bag 210 may positioned with the base 300 against the inside of the hopper lid 200 and the attachment posts 203 may be inserted through securement apertures 330 to secure the toner bag 210 to the hopper lid 200. The ends 425, 430 of the seal puller 215 may then be inserted into their respective support locations provided by the hopper base 205. The hopper lid 200 and hopper base 205 may then be reassembled and reattached to one another. Those skilled in the art will appreciate that a complete remanufacturing operation may include steps in addition to those mentioned above, including cleaning and replacement or repair of the various blades, rollers, seals, and the like present on a typical toner cartridge. In addition, those skilled in the art will recognize that the steps described above need not necessarily be performed in the order described, and that some steps may be eliminated altogether. When the remanufacturing process is complete and the cartridge 100 is installed in a printer, rotational driving force from the printer is transferred to the gear 220, which rotates the seal puller 215 which pulls the seal 110 away from the toner bag 210, thereby allowing toner to flow through the toner openings 335 for use during printing operations.

Thus, the invention provides, among other things, a system and method of remanufacturing a toner cartridge. Various features and advantages of the invention are set forth in the following claims.

What is claimed is:

1. A method of refilling a used flexible toner container having a plurality of toner openings configured to discharge toner during a print operation, the used flexible toner container including a base and a body, the method comprising:

forming a fill opening in the used flexible toner container by separating, from inside the flexible toner container, the base from the body, the fill opening being formed separately from the toner openings;

attaching a toner seal to the flexible toner container to cover the plurality of toner openings;

after attaching the toner seal, refilling the flexible toner container via the fill opening; and sealing the fill opening.

2. The method of claim 1, wherein sealing the fill opening includes reattaching the base to the body in the vicinity of the fill opening.

3. The method of claim 2, wherein reattaching the base to the body includes at least one of heat sealing the base to the body, sonic welding the base to the body, and applying adhesive between the base and the body.

4. The method of claim 1, wherein the base is formed of a first material and the body is formed of a second material.

5. The method of claim 1, wherein attaching the toner seal to the flexible toner container includes heat sealing the toner seal to the flexible toner container.

6. The method of claim 1, wherein attaching the toner seal to the flexible toner container includes flattening the flexible toner container.

7. The method of claim 6, wherein the body defines the toner openings, and wherein flattening the flexible toner container includes flattening the body so the toner openings are substantially parallel to the base.

8. The method of claim 1, wherein forming the fill opening in the flexible container includes forming the fill opening in a longitudinal end of the flexible toner container.

9. The method of claim 1, wherein refilling the flexible toner container includes providing a vacuum source.

10. The method of claim 1, wherein refilling the flexible toner container includes providing a vibration source.

11. The method of claim 1, wherein the toner seal includes a seal base, a plate secured to the seal base, and a release liner secured to the plate and covering an adhesive, and wherein attaching the toner seal to the flexible toner container includes removing the release liner to expose the adhesive and attaching the toner seal to the flexible toner container via the adhesive.

12. The method of claim 11, wherein the plate defines a plate opening and wherein attaching the toner seal to the flexible toner container includes positioning the plate opening over at least one of the toner openings.

13. The method of claim 11, wherein the plate is secured to the seal base via a heat seal pattern, the method further comprising exposing the toner openings by overcoming the heat seal pattern to separate the seal base from the plate.

14. The method of claim 11, further comprising attaching the seal puller to the seal base.

15. The method of claim 14, wherein the seal puller is attached to the seal base before attaching the toner seal to the flexible container.

16. The method of claim 1, wherein the toner seal is a used toner seal that was previously removed from the flexible container, and wherein attaching the toner seal to the flexible toner container includes reattaching the used toner seal to the flexible toner container.

17. The method of claim 16, wherein the used toner seal was previously removed from the flexible toner container by a seal puller to which the used toner seal is coupled, and wherein the used toner seal remains coupled to the seal puller while the used toner seal is reattached to the flexible toner container.

18. The method of claim 1, wherein forming a fill opening includes inserting a separating tool through one of the toner openings to separate, from inside the flexible toner container, the base from the body with the separating tool.

19. The method of claim 18, wherein the separating tool includes a sharp end and forming a fill opening includes separating the base from the body with the sharp end of the tool from inside the flexible toner container.

20. A method for remanufacturing a toner cartridge, the method comprising:

providing a used toner cartridge including a toner hopper having a flexible toner container therein, the flexible toner container including a base and a body;

opening the toner hopper;

removing the flexible toner container from the toner hopper, the flexible toner container having a plurality of toner openings configured to discharge toner during a print operation;

forming a fill opening in the flexible toner container by separating, from inside the flexible toner container, the base from the body, the fill opening being formed separately from the toner openings;

attaching a toner seal to the flexible toner container to cover the plurality of toner openings;

after attaching the toner seal, refilling the flexible toner container with toner via the fill opening;

sealing the fill opening; and reinstalling the refilled flexible toner container into the hopper.

21. The method of claim 20, wherein the used toner cartridge further includes a toner seal and a seal puller attached to the toner seal, the method further comprising:

removing the toner seal and the seal puller as a unit from the toner hopper;

leaving the toner seal and the seal puller attached to one another while attaching the toner seal to the flexible toner container; and reinstalling the toner seal and the seal puller into the hopper together with the refilled flexible toner container.

22. The method of claim 20, wherein forming a fill opening includes inserting a separating tool through one of the toner openings to separate, from inside the flexible toner container, the base from the body with the separating tool.

23. The method of claim 22, wherein the separating tool includes a sharp end and forming a fill opening includes separating the base from the body with the sharp end of the tool from inside the flexible toner container.

24. A method of refilling a used flexible toner container having a plurality of toner openings configured to discharge toner during a print operation, the used flexible toner container including a base and a body, the method comprising:

forming a fill opening in the used flexible toner container by separating, from inside the flexible toner container, the base from the body, the fill opening being formed separately from the toner openings;

attaching a toner seal to the flexible toner container to cover the plurality of toner openings;

after attaching the toner seal, refilling the flexible toner container via the fill opening; and sealing the fill opening, wherein attaching the toner seal to the flexible toner container includes flattening the flexible toner container.

25. The method of claim 24, wherein sealing the fill opening includes reattaching the base to the body in the vicinity of the fill opening.

26. The method of claim 25, wherein reattaching the base to the body includes at least one of heat sealing the base to the body, sonic welding the base to the body, and applying adhesive between the base and the body.

27. The method of claim 24, wherein the base is formed of a first material and the body is formed of a second material.

28. The method of claim 24, wherein attaching the toner seal to the flexible toner container includes heat sealing the toner seal to the flexible toner container.

29. The method of claim 24, wherein the body defines the toner openings, and wherein flattening the flexible toner container includes flattening the body so the toner openings are substantially parallel to the base.

30. The method of claim 24, wherein forming the fill opening in the flexible container includes forming the fill opening in a longitudinal end of the flexible toner container.

31. The method of claim 24, wherein refilling the flexible toner container includes providing a vacuum source.

32. The method of claim 24, wherein refilling the flexible toner container includes providing a vibration source.

33. The method of claim 24, wherein the toner seal includes a seal base, a plate secured to the seal base, and a release liner secured to the plate and covering an adhesive, and wherein attaching the toner seal to the flexible toner container includes removing the release liner to expose the adhesive and attaching the toner seal to the flexible toner container via the adhesive.

34. The method of claim 33, wherein the plate defines a plate opening and wherein attaching the toner seal to the flexible toner container includes positioning the plate opening over at least one of the toner openings.

35. The method of claim 33, wherein the plate is secured to the seal base via a heat seal pattern, the method further comprising exposing the toner openings by overcoming the heat seal pattern to separate the seal base from the plate.

36. The method of claim 33, further comprising attaching the seal puller to the seal base.

37. The method of claim 36, wherein the seal puller is attached to the seal base before attaching the toner seal to the flexible container.

38. The method of claim 24, wherein forming a fill opening includes inserting a separating tool through one of the toner openings to separate, from inside the flexible toner container, the base from the body with the separating tool.

39. The method of claim 38, wherein the separating tool includes a sharp end and forming a fill opening includes separating the base from the body with the sharp end of the tool from inside the flexible toner container.

* * * * *